US005916526A

United States Patent [19]

Robbins

[11] Patent Number: 5,916,526

[45] Date of Patent: Jun. 29, 1999

[54] COMPARTMENTALIZED MULTI-WELL CONTAINER

[75] Inventor: Paul B. Robbins, Palo Alto, Calif.

[73] Assignee: Robbins Scientific Corporation, Sunnyvale, Calif.

[21] Appl. No.: 08/945,870

[22] PCT Filed: Aug. 9, 1996

[86] PCT No.: PCT/US96/12985

§ 371 Date: Nov. 3, 1997

§ 102(e) Date: Nov. 3, 1997

[87] PCT Pub. No.: WO97/06890

PCT Pub. Date: Feb. 27, 1997

Related U.S. Application Data

[60] Provisional application No. 60/002,212, Aug. 11, 1995.

[51] Int. Cl.[6] ..... B01L 3/00; B01L 3/14

[52] U.S. Cl. ..... 422/102; 422/99

[58] Field of Search ..... 422/82.05, 99, 422/101, 102; 356/246, 440; 435/284, 301

[56] References Cited

U.S. PATENT DOCUMENTS

| | | | |
|---|---|---|---|
| 3,850,174 | 11/1974 | Ayres | 422/102 X |
| 4,150,089 | 4/1979 | Linet | 422/102 |
| 4,197,287 | 4/1980 | Piasio et al. | 424/1 |
| 4,225,575 | 9/1980 | Piasio et al. | 424/1 |
| 4,639,242 | 1/1987 | Babson | 494/37 |
| 4,789,639 | 12/1988 | Fleming | 436/178 |
| 4,828,386 | 5/1989 | Matkovich et al. | 356/246 |
| 5,120,503 | 6/1992 | Hinckley et al. | 422/102 |
| 5,225,164 | 7/1993 | Astle | 422/102 |
| 5,455,009 | 10/1995 | Vogler et al. | 422/102 |
| 5,620,662 | 4/1997 | Perlman | 422/102 |
| 5,830,411 | 11/1998 | Gisper-Sauch | 422/102 X |

OTHER PUBLICATIONS

"Nunc's 384 Well Plate" (Nunc, Inc. promotional material), 2 pages, no date available.

*Primary Examiner*—Jill Warden
*Assistant Examiner*—Alexander Markoff
*Attorney, Agent, or Firm*—Larry B. Guernsey; Michael J. Hughes; Mark E. Baze

[57] ABSTRACT

A multi-well container (10) is provided in which a greater number of wells may exist than heretofore possible while still maintaining a standard multi-well plate tube array format and footprint. The multi-well container (10) is comprised of a rectangular array of tubes (12) in standard tube format held together by an integrally fashioned plate portion (16). The tubes (12) are subdivided by partitions or septa (14) which extend the height of the tubes (12). Each septum (14) may constitute a single wall or may be comprised of any number of fins (32) which are integral with internal tube surfaces (28). In a symmetrical design with four such fins (32), the fins (32) radiate at angular intervals of 90 degrees from a common central axis (34) with which all four fins (32) are integral. Thus, the septa (14) serve to compartmentalize each tube (12) into symmetrical quadrants of four smaller wells or sub-tubes (30). The preferred embodiment is directed toward usage in conjunction with PCR thermal cyclers, but the multi-well container (10) and the elements as are embodied therein are generally applicable to any laboratory procedure where multiple samples must be treated, evaluated, or stored.

17 Claims, 3 Drawing Sheets

COMPARTMENTALIZED MULTI-WELL CONTAINER

This application is a National Stage of the PCT/US96/12985, filed on Aug. 9, 1996, which claims priority from U.S. Provisional Application Ser. No 60/002,212, filed on Aug. 11, 1995 by Paul B. Robbins, which is hereby incorporated by reference in its entirety.

TECHNICAL FIELD

The present invention relates generally to containers for holding liquids, reagents, and materials, for testing, analytical procedures, and performance of chemical reactions, and more particularly to a container for multiplicatively increasing the number of such tests, analyses, or reactions that may be performed at one time.

BACKGROUND ART

Multi-well plates, or two-dimensionally bound arrays of wells or reaction chambers, are commonly employed in research and clinical procedures for the screening and evaluation of multiple samples. Multi-well plates are especially useful in conjunction with automated thermal cyclers for performing the widely used polymerase chain reaction, or "PCR," and for DNA cycle sequencing and the like. They are also highly useful for biological micro-culturing and assay procedures, and for performing chemical syntheses on a micro scale.

Multi-well plates may have wells or tubes that have single openings at their top ends, similar to conventional test tubes and centrifuge tubes, or they may incorporate second openings at their bottom ends which are fitted with frits or filter media to provide a filtration capability. As implied above, multi-well plates are most often used for relatively small scale laboratory procedures and are therefore also commonly known as "microplates."

Multi-well plates are typically comprised of a plurality of plastic tubes arranged in rectangular planar arrays of either 6×8 (a 48-well plate) or 8×12 (a 96-well plate) tubes with an industry standard 9 mm (0.35 in.) center-to-center tube spacing (or fractions thereof). A horizontally disposed tray or plate portion generally extends integrally between each tube, interconnecting each tube with its neighbor in cross-web fashion, although in certain square-shaped tube designs the tubes may share the walls of their neighbors along the height of the tubes. In the case of multi-well plates that are of the non-filtration variety, the bottoms of the tubes may be of a rounded conical shape (as generally used for thermal cycling and to ensure complete transfer of samples), or they may be flat-bottomed (typical with either round or square-shaped designs used with optical readers). Multi-well "plates" may also exist in a "strip" form wherein but a single planar row of interconnected tubes is provided.

It will be apparent that as many as 96 individual reaction mixtures might be simultaneously subjected to, for example, PCR treatment by placing a single multi-well plate within a thermal cycler unit. Most commercial thermal cyclers that are presently available have heating/cooling blocks with conically shaped depressions, typically 96 in number, which are specifically designed and arrayed for mateably receiving the lower portion of the tubes of multi-well plates so that intimate and uniform heating of the PCR reaction mixtures contained within the wells (tubes) may occur.

It is becoming increasingly the case with a variety of operations, however, and especially with PCR, that it would be extremely beneficial to treat or manipulate, at the same time, a multitude of individual samples much greater than 96 in number. This is the case in the human genome project, for example. When a large number of samples must be processed, it is necessary to use a number of multi-well plates, which then must be handled sequentially one at a time. A number of multi-well plates may also be required for storing large numbers of samples.

In the past couple of years, multi-well plates in a 384 tube, 16×24 array format, have appeared on the laboratory scene in an attempt to offer to the researcher or clinician the ability to multiplicatively increase the processing capability for the assay or reaction process that is being carried out. These new 384-well plates have the same general dimensions or "footprint" as the standard 96-well plates, but have four wells occupying the same space as a single well (and associated cross-webbing) in a 96-well plate.

The 384-well plates which are currently available may be of a design similar to standard 96-well plates, wherein discrete tubes are present but in which the tubes have smaller diameter tube openings (and a correspondingly smaller center-to-center tube spacing as well). They may also be in a form such as the 384-well plate design currently offered by Nunc, Inc. of Naperville, Ill., wherein square "tubes" are provided with each "tube" sharing the walls of its neighbors in contiguous fashion.

The new 384-well plates do offer advantages in that sample density is quadrupled, and these plates, having the same footprint as the 96-well plates, are compatible with a number of existing devices, including heating blocks for incubation purposes, microplate readers, and various robotic systems. The 384-well plates also optimize bench top and storage space, especially with regard to the extended storage of samples in refrigerator and freezer space, such space generally being in limited supply in most laboratories and clinics.

There is at least one area in particular, however, where the 384-well plates as are presently known are severely deficient, and that is with regard to PCR thermal cycling. Currently available 384-well plates are not compatible with the depression design found in existing (96 format) PCR heating blocks. As noted above, PCR heating blocks are specifically designed to hold and heat tubes that are arrayed 96 in number. Thus, with regard to PCR testing, it is still necessary to employ more than one 96-well plate in sequential fashion for evaluation of more than 96 samples. Only very recently has any manufacturer marketed a 384-well thermal cycler. As it presently stands, if a laboratory or clinic wishes to have available the option to simultaneously treat more than 96 samples, it must purchase the new 384-well design thermal cycler or a new 384 depression heating block for an existing unit or, of course, purchase more than one 96-well thermal cycler. All of these options are expensive and, in the latter case, additional precious laboratory space is consumed by yet another instrument.

Because of the limitations associated with presently available multi-well plates which offer more than 96 wells, a great need still exists for a multi-well plate that is capable of providing a multiplicatively increased number of sample wells greater than 96, but which retains a standard 96-well plate footprint and yet is also suitable for use in conjunction with the 96-depression heating blocks of existing thermal cyclers.

DISCLOSURE OF THE INVENTION

Accordingly, it is an object of the present invention to provide a multi-well container having a multiplicatively increased sample number holding capability.

It is another object of the invention to provide a multi-well container having tubes that are compartmentalized or subdivided.

It is a further object to provide a multi-well container of multiplicatively increased sample number holding ability that retains a standard footprint size.

It is yet another object to provide a multi-well container of multiplicatively increased sample number holding ability that retains a standard tube spacing and tube array format.

It is yet a further object to provide a multi-well container of multiplicatively increased sample number holding ability that is amenable to standard injection molding techniques.

It is still another object to provide a multi-well container that provides a cost savings to the consumer over existing multi-well plates.

It is a still further object to provide a multi-well container that is suitable for a wide range of scientific and medical applications.

Briefly, the preferred embodiment of the present invention is a container of the multi-well plate genre in which a greater number of wells are provided than heretofore possible while still maintaining a standard tube array format. The preferred embodiment is directed toward usage in conjunction with PCR thermal cyclers, but the container and the elements as are embodied therein are generally applicable to any laboratory procedure where multiple samples must be treated, evaluated or stored.

The multi-well container is comprised of a rectangular array of tubes in standard tube format held together by an integrally fashioned plate portion. The tubes are subdivided by partitions or septa which extend the height of the tubes from a tube bottom to a tube rim. Each septum may constitute a single wall or may be comprised of any number of fins which are integral with internal tube surfaces. In a symmetrical design with four such fins, the fins radiate at angular intervals of 90 degrees from a common central axis with which all four fins are integral. Thus, the septa serve to compartmentalize each tube into symmetrical quadrants of four smaller wells or sub-tubes.

Thus, a standard number and array of tubes are presented to be compatible with the heating blocks of most thermal cyclers, while providing a multiplicatively increased number of wells. The wells (sub-tubes) themselves maintain a standard distance as between corresponding well quadrants (where four fins are present) in adjacent tubes so that the design is compatible with all manner of standard multichannel pipetting equipment.

An advantage of the present invention is that it provides a multiplicatively increased number of wells while maintaining a dimensionally restricted footprint size.

Another advantage of the invention is that it provides a multiplicatively increased number of wells while presenting a tube number and array that is compatible with the heating block components of existing thermal cyclers and the platforms or stations of other laboratory equipment.

A further advantage is that a multiplicatively increased number of wells are provided while maintaining a dimensionally restricted footprint size wherein the well positioning is compatible with existing multi-channel pipetting equipment.

Yet another advantage is that for applications such as DNA cycle sequencing (di-primer type), the pooling of multiple samples is made much more rapid and efficient over existing 384-well plates.

Yet a further advantage is that an increased sample processing and throughput capability is provided at no additional cost.

Still another advantage is that the numbers of multi-well plates that must be handled is reduced and inventory management is simplified.

Still a further advantage is that where, as in the preferred embodiment, the septa extend the full height of the tube, better structural support is given to sealing mats or gaskets that are commonly used to seal the open ends of the tubes of multi-well plates.

Yet another advantage of the invention is that, because discrete tubes are provided, there is less chance of cross-contamination between wells as compared to currently available 384-well plates in which the tubes share neighboring tube walls.

Yet a further advantage of the present invention is that fewer multi-well plates need be purchased to handle the same volume and numbers of samples, thereby providing a supplies cost savings.

These and other objects and advantages of the present invention will become clear to those skilled in the art in view of the description of the best presently known mode of carrying out the invention as described herein and as illustrated in the several figures of the drawings.

DESCRIPTION AND BEST MODE OF THE INVENTION

Figure 1:
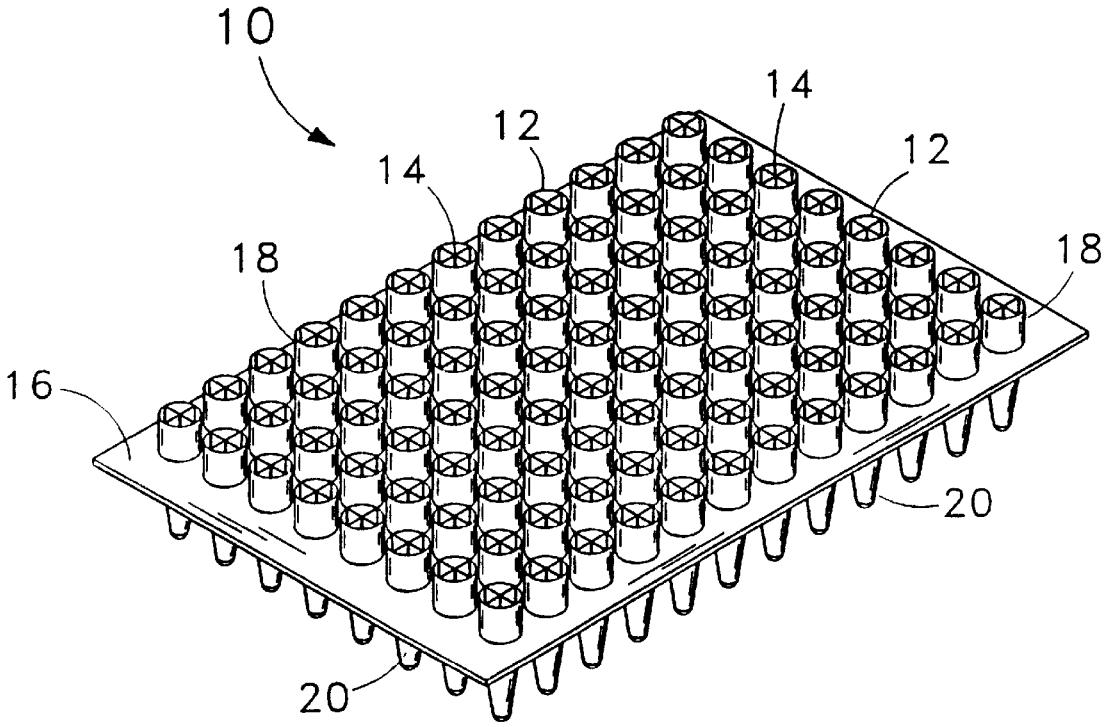
FIG. 1 is a perspective view of a container of the preferred embodiment of the present invention.

The preferred embodiment of the present invention is a container for multiplying the number of tests, reactions, or analyses that may be carried out by instruments and equipment utilizing standardized container holders or which incorporate portals, spaces, or stages for receiving standardized containers. The container of the preferred embodiment is directed toward testing as employs the polymerase chain reaction (PCR) in thermal cycle DNA sequencing and is set forth in FIG. 1, where it is designated therein by the general reference character 10.

Referring initially to the perspective view in FIG. 1 of the drawings, the container 10 is shown to be comprised of elements of three major types. Thus, a plurality of discrete tubes 12 are compartmentalized by partitions or septa 14 and are further held in ordered rectangular planar array by a horizontally extending and relatively rigid plate portion 16. The orientation of the tubes 12 is so as to be in perpendicular relation to the plate portion 16. For reference purposes only, the plate portion 16 may be considered to "divide" each tube 12 into an upper portion 18 and a lower portion 20, although no such physical division actually occurs, the material comprising the plate portion 16 merely surrounding each tube 12 in integral, cross-web fashion and interconnectedly holding the tubes 12 together thereby.

Figure 2:
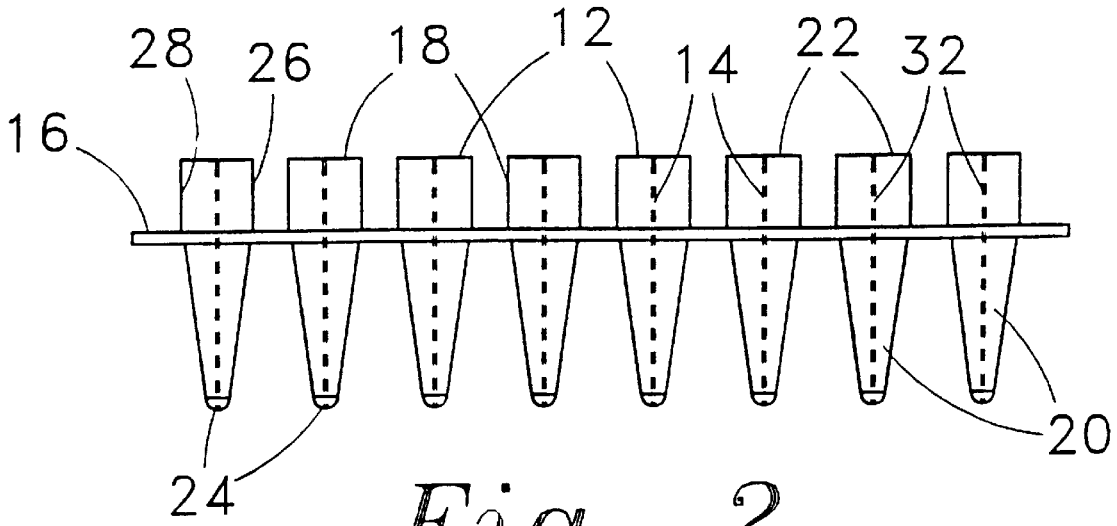
FIG. 2 is a side elevational view of the container of FIG. 1.
Figure 3:
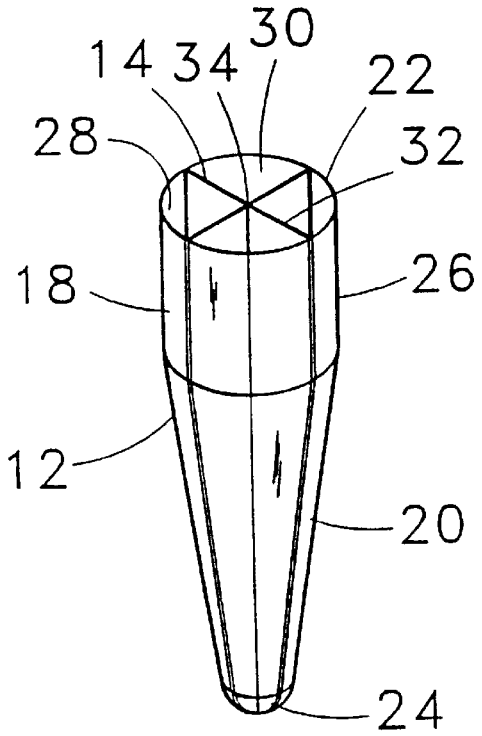
FIG. 3 is a perspective view of an individual tube of the container of FIG. 1.

Referring now to the side elevational view of FIG. 2 and to the single-tube perspective view of FIG. 3, the upper portion 18 of each tube 12 is shown to have a generally cylindrical shape and includes a tube rim 22. The lower portion 20 of each tube 12 has a generally rounded conical shape and includes a tube bottom 24. The upper and lower portions (18 and 20) are integral with one another and together form a tube wall 26 having a vertically continuous internal tube surface 28, while defining a shape, and consequently a vessel, somewhat similar in appearance to a common laboratory centrifuge tube, albeit a much smaller version thereof.

It is to be understood that the particular shape of the tubes 12 of the preferred embodiment, which is directed toward PCR testing, is only important in so much as it assists in the reaction and removal of the small quantities of liquids, reagents, and materials as are typically employed in PCR testing and other procedures and, moreover, that it is of the correct shape to be mateably received by the depressions found in the heating/cooling blocks of standard 96-well thermal cycler units (not shown).

Thus, the tube 12 may, in fact, be of any tube shape that might be employed in a variety of testing and analytical procedures in which sample throughput is limited only by the number of samples that may be processed at one time. For example, the shape might be that of a conventional test tube, or the tube 12 may have a three-dimensional square or triangular appearance, etc. The tubes 12 also need not have a conical aspect, of course, but may have a tube wall 26 that is uniformly cylindrical and vertical along the height of the tube 26. The tubes 12 may also have tube bottoms 24 that are flat. Tubes such as the foregoing are commonly used for microcell culturing and cloning, and in conjunction with analyses performed with optical readers. In addition, the tubes 12 may also have a filtration capability wherein the lower portions 20 are open-ended and fitted with a frit or other filter medium.

Further, it is apparent that the tubes 12 need not be held in the desired planar array by a plate portion 16 at the precise elevation as indicated in the drawings. A similar plate portion might connect the tubes 12 at the tube rims 22, or at any other location upon the tubes 12. Any such plate portion 16 might even be absent altogether, as in the case where the tubes 12 would be formed and arrayed so that the tube walls 26 are shared between adjacent tubes 12, thereby providing integral plate-like support (the tube walls 26 of the lower portion 20 may remain discrete). It is also the case that the tubes 12 may be held in a planar array that is simply a single row of interconnected tubes 12, i.e., in the form of a "strip," rather than a "plate." Such a strip of tubes 12 may be relatively rigid or flexible as desired.

Again, the plate portion 16 design as shown is directed toward PCR thermal cycler use in which the lower portions 20 of the tubes 12 are received by the heating block, and wherein the upper portions 18 extend above the plate portion 16 at a height sufficient to help reduce cross contamination between samples during processing and manipulations.

Figure 4:
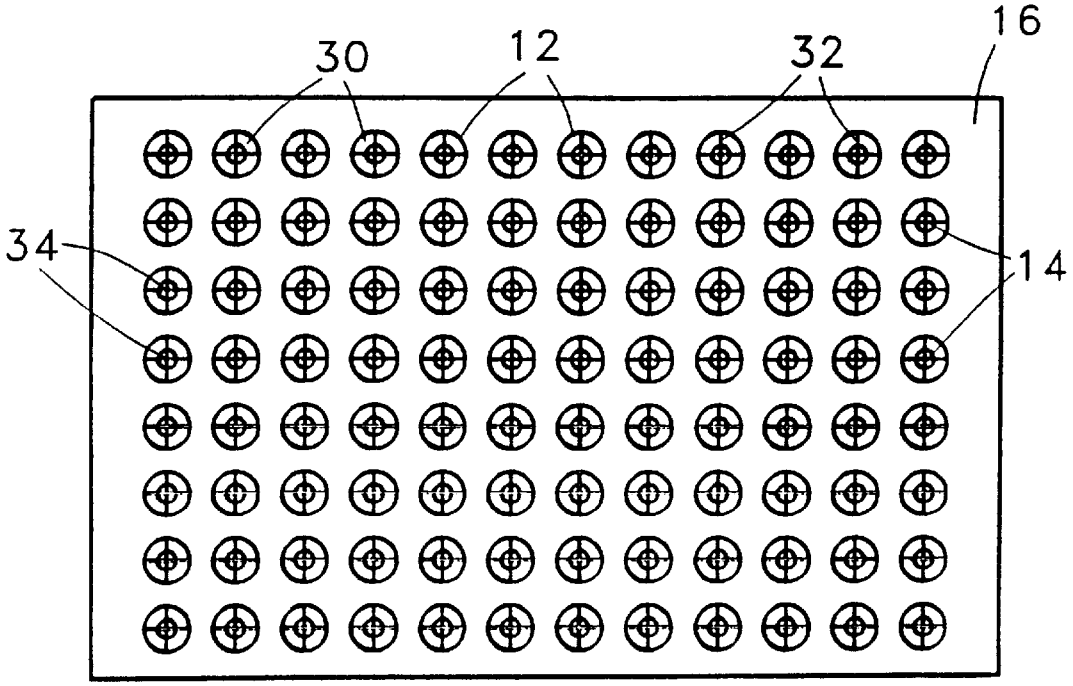
FIG. 4 is a top plan view of the container of FIG. 1.

The tubes 12 depart from conventional testing and analysis multi-well containers as are currently known by the incorporation of the aforementioned dividing septa 14. As shown in FIG. 3 and the top plan view of FIG. 4, the septa 14 are structures integrally contained within each tube 12 and which serve to symmetrically compartmentalize and subdivide each tube 12 into four quadrants or sub-tubes 30. (For the purposes herein, the term "septum," and its plural form "septa," may refer to a single dividing wall, or to a more complicated "fin" structure, as will be clear.)

The septa 14 may each be considered to be comprised of four fins 32. The fins 32 are thin, wall-like structures that extend for the height of the tube 12, from the tube bottom 24 to the tube rim 22, and radiate orthogonally from a common central axis 34 at angular intervals of 90 degrees about that central axis 34. The fins 32 are integral amongst each other at the juncture of the central axis 34 and are further integral with the tube bottom 24 and the tube wall 26. Thus, each sub-tube 30 is an individual well separately capable of containing liquids and materials for testing and analysis, and the capacity of each tube 12 for such testing and analysis is consequently multiplicatively increased by a factor of four thereby.

It will be apparent that the central axes 34 may be of varying thicknesses or diameters. Sizes ranging from a thickness no greater than that of the fins 34, as in the simple intersecting fin design shown, to a considerably larger diameter size that is even capable of incorporating a fifth, centrally located sub-tube (not shown) are contemplated.

With an array format of eight by twelve tubes 12, the multi-well container 10 of the present invention provides, then, that 384 wells are able to be offered within the same dimensions as a standard 96-well plate, with tubes 12 that are also arrayed, numbered, and presented, as if a 96-well plate. Thus, the container 10 of the preferred embodiment provides that the number of samples for testing and analysis, and especially with regard to PCR, may be multiplicatively increased without modification or replacement of existing equipment, or equipment components and container holders. The container 10 is also especially useful for the storage of large numbers of samples, the container 10 offering four times the sample number storage capability in the same volume of space as occupied by conventional multi-well containers.

Further, it will be appreciated that, as between each sub-tube 30 bearing the same quadrant relation as to another sub-tube 30 of an adjacent tube 12, those sub-tubes 30 will be spaced apart at a distance that is identical to the distance between the central axes 34 of the adjacent tubes 12. Since the tubes 12 themselves are arrayed according to industry standard formats, that sub-tube 30-to-sub-tube 30 distance is compatible with presently available robotics and manual multi-channel pipettes (i.e., entire rows of corresponding sub-tubes 30 may be simultaneously filled or drained as is done with conventional, non-compartmentalized multi-well plates).

Figure 5:
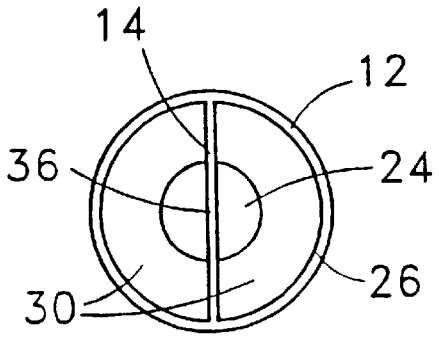
FIG. 5 is an alternative design for tube compartmentalization.

It is to be understood that the container 10 of the present invention is not to be limited to compartmentalization into four sub-tubes 30 only. It would be apparent to one of ordinary skill in the art that any number of such sub-tubes 30 might be designed within a given tube 12. Thus, as shown in FIG. 5, septa 14 having only a single, diametrically disposed "fin" or partition wall 36 might be employed to compartmentalize each tube 12 into two sub-tubes 30, whereby the testing capacity of the container 10 would be correspondingly multiplied by a factor of two, rather than four.

Figure 6:
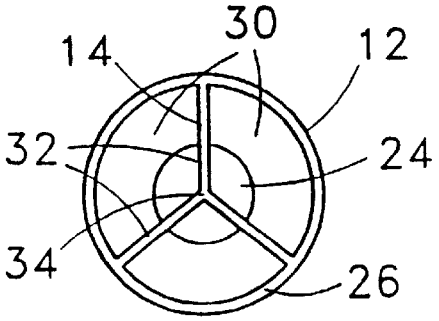
FIG. 6 is an additional alternative design for tube compartmentalization.

Similarly, and as shown in FIG. 6, septa 14 having a Y-shaped cross-section, in which three films 32 radiate from a common central axis 34, might be incorporated into the tubes 12 in order to increase the testing or analysis capacity by threefold, and so on. It would also be apparent that tubes 12 having varying numbers of sub-tubes 30 might be present within the same container 10. It would further be apparent that the tubes 12 might incorporate two or more sub-tubes 30 of differing sizes and capacities.

It is also to be understood that the container 10 of the present invention is not to be limited to the particular array of tubes 12 shown, or even to being comprised of a plurality of interconnected tubes 12. The container 10 may in fact be comprised of a single, compartmentalized tube 12 incorporating any of a number of compartmentalization designs as exemplified above (for example, as in FIG. 3). Such a single tube 12 might have application as a centrifuge tube, for example, whereby more samples could be processed in a single centrifuging operation than is possible with conventional, non-compartmentalized centrifuge tubes as are currently available.

Finally, it is to be understood that the container 10 of the present invention may be used as a replacement for any container that is used in conjunction with a standardized container holder or receiving aperture, space or stage, in order to increase the number of tests,, analyses, reactions, procedures, etc., that may be simultaneously performed by a given machine or by a given operator at one time, and thus is not to be limited only to the preferred embodiment as directed toward PCR testing.

The container 10 of the preferred embodiment is integrally formed by conventional injection molding, with the preferred injection material being polypropylene plastic. It would be apparent to one with ordinary skill in the art, that other plastics, polystyrene and polycarbonate, for example, or even glasses and metals, might be utilized in the same or similar forming processes as well.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The compartmentalized multi-well container 10 of the present invention is designed to be used for any scientific or clinical procedure as might employ conventional multi-well plates (or "strips" ) as have existed heretofore. The invention 10 of the presently preferred embodiment is found to be especially beneficial when used in conjunction with the equipment used for PCR and with any other laboratory equipment requiring a standard multi-well plate tube array and wherein the researcher or operator desires the ability to simultaneously process more samples than what a standard multi-well plate offers.

In most respects, use of the multi-well container 10 is precisely the same as with conventional multi-well containers. Typically, individual samples or substrates are loaded into the sub-tubes 30 together with solvents and reagents (if necessary for the particular procedure). The spacing of the sub-tubes 30 as between individual tubes 12 is such that standard multi-channel pipettes and robotics may be conveniently employed for solvent and liquid reagent addition, for solution removal and transfer, and for washing and the like, as such dispensing devices are used with conventional multi-well plates. The solution-containing sub-tubes 30 then might be subjected to heat treatment (generally after first covering the tubes 12 with a lid or cover), or optically read, etc., as the case may be.

In the case of PCR, the subdivided tubes 12 are able to be inserted into the depressions present in pre-existing thermal cycler heating blocks, whereby the number of PCR events that may be carried out at one time are multiplicatively increased. In the case of DNA cycle sequencing, the multi-well container 10 provides an extraordinary convenience in that the several reaction solutions that necessarily require pooling during the sequencing processes may be so pooled by simply inverting the container 10 over a standard multi-well plate. The contents of the neighboring sub-tubes 30, for which pooling is desired, are thus directly emptied and combined into single wells, without the need to individually transfer by pipette each original volume of solution.

The multi-well container 10 thus provides that the researcher or clinician becomes more efficient, and that considerable time is saved in the processing and evaluation of samples. For the foregoing reasons, and for numerous others as set forth previously herein, it is expected that the industrial applicability and commercial utility of the present invention will be extensive and long lasting.

What is claimed is:

1. A multi-well plate comprising:

a plurality of discrete tubes, each said tube having a tube wall, a tube bottom and a tube rim, each tube wall having an internal tube surface, each said tube being subdivided into at least two sub-tubes by at least one substantially vertical partitioning fin integral with said internal tube surface, said at least one partitioning fin extending from said tube bottom to said tube rim; and binding means for binding said tubes together in a planar array format.

2. The multi-well plate of claim 1 wherein:

each tube is subdivided into four such sub-tubes by four such fins radiating at angular intervals of ninety degrees about an integral central axis.

3. The multi-well plate of claim 1 wherein:

each tube has a lower portion of a generally conical shape.

4. The multi-well plate of claim 1 wherein:

said binding means includes a horizontally extending and relatively rigid cross-webbing structure external to and integral with the tube walls.

5. The multi-well plate of claim 4 wherein:

each said tube further has a tube opening and a tube height that extend above the cross-webbing structure to reduce cross-contamination between said tubes.

6. The multi-well plate of claim 1 wherein:

the array format is a rectangular array of eight by twelve said tubes.

7. A multi-well container comprising:

a plurality of discrete tubes, each tube having a first open end, a second closed end, and an internal tube surface;

a plurality of partitioning structures, each partitioning structure extending from the first open end to the second closed end, each partitioning structure integral and continuous with the internal tube surface and the second closed end and dividing each tube into at least two wells, such that each partitioning structure is non-removable and effects a sealing capability with respect to the internal tube surface and the second closed end, and whereby each well is separately capable of containing a liquid; and a plate portion, said tubes being secured to said plate portion in a planar array.

8. The multi-well container of claim 7 wherein:

each said partitioning structure is symmetrically disposed within each said tube to divide each said tube into four quadrant wells.

9. The multi-well container of claim 7 wherein:

the second closed end is narrower than the first open end and is tapered to provide that said tubes have a generally conical shape.

10. The multi-well container of claim 8 wherein:

said tubes are integral with said plate portion.

11. The multi-well container of claim 7 wherein:

the array is a rectangular array of eight by twelve said tubes.

12. In an improved container consisting of discrete tubes in a planar array, each tube having a tube wall, a tube bottom and a tube rim, the improvement comprising:

providing at least one septum disposed within each tube and integral and continuous with the tube wall thereof, said septum extending from said tube bottom to said tube rim to form at least two wells coexisting within the same said tube, such that each septum is non-removable and effects a sealing capability with respect to the tube wall, and whereby each well is separately capable of containing a liquid.

13. The improved container of claim 12 wherein:

each said septum is in the form of a single, diametrically disposed partitioning wall.

14. The improved container of claim 12 wherein:

each said septum is comprised of at least three fins integrally radiating about a common central axis.

15. In an improved container consisting of a discrete tube having a tube wall, a tube rim, and a tube bottom, the improvement comprising:

providing at least one septum disposed within said tube and integral with the tube wall and the tube bottom, said septum continuously extending from said tube bottom to said tube rim to form at least two wells coexisting within said tube.

16. The improved container of claim 15 wherein:

each said septum is in the form of a single, diametrically disposed partitioning wall.

17. The improved container of claim 15 wherein:

each said septum is comprised of at least three fins integrally radiating about a common central axis.

* * * * *